US005131853A

United States Patent [19]

Meyer

[11] Patent Number: 5,131,853

[45] Date of Patent: Jul. 21, 1992

[54] LOW PROFILE RECEPTACLE TERMINAL FOR SOLDERING TO A CIRCUIT BOARD

[75] Inventor: Kevin E. Meyer, Kokomo, Ind.

[73] Assignee: Delco Electronics Corporation, Kokomo, Ind.

[21] Appl. No.: 744,095

[22] Filed: Aug. 12, 1991

[51] Int. Cl.[5] ..... H01R 9/09

[52] U.S. Cl. ..... 439/82; 439/83; 439/853

[58] Field of Search ..... 439/80-83, 439/851-853, 859, 872, 876

[56] References Cited

U.S. PATENT DOCUMENTS

| | | | |
|---|---|---|---|
| 3,654,583 | 4/1972 | Mancini | 439/83 |
| 3,699,495 | 10/1972 | Raynor | 339/17 |
| 3,778,755 | 12/1973 | Marks | 439/853 |
| 4,515,422 | 5/1985 | Pritulsky | 439/82 |
| 4,797,110 | 1/1989 | Ponziani et al. | 439/83 |
| 4,842,552 | 6/1989 | Frantz | 439/82 |
| 4,946,408 | 8/1990 | Garrett et al. | 439/872 |

*Primary Examiner*—Paula A. Bradley

*Attorney, Agent, or Firm*—Francis J. Fodale

[57] ABSTRACT

A low profile receptacle terminal of unitary construction includes an integral head portion with a perimeter wall of low profile; the perimeter wall has a plurality of integral spring contact fingers thereon each connected at one end to the perimeter wall and each having a free end thereon located within the perimeter wall and bent at an acute angle with respect to the upper edge of the perimeter wall so as to reduce the height of the head portion; the spring contact fingers have a free state position; the head portion is spaced from a gage can by a clearance that prevents electrical shorting between an electrical component and the receptacle terminal. Integral spring clips connect the receptacle terminal to the circuit board and the spring clips have a vertical dimension for solder flow to electrically connect the receptacle terminal to conductor strips on the circuit board without wicking solder to the spring contact fingers whereby the spring contact fingers will selectively engage and release a conductor pin of an electrical device connected to the component side of the circuit board.

6 Claims, 2 Drawing Sheets

LOW PROFILE RECEPTACLE TERMINAL FOR SOLDERING TO A CIRCUIT BOARD

FIELD OF THE INVENTION

This invention relates to receptacle terminals for connection to circuit boards and more particularly to receptacle terminals connected to the component side of a circuit board and having spring clip connectors soldered to conductor strips on the non-component side of the circuit board by wave soldering.

BACKGROUND ART

Various receptacle terminals are known for connecting an electrical component to conductor strips on a circuit board.

One problem has been the height of such receptacles and the manner in which they are assembled to circuit boards and wave soldered thereon.

Receptacle terminals have been used in the past, in one case shown in U.S. Pat. No. 3,699,495 granted to Terence Robert Raynor Oct. 17, 1972; the receptacle '495 patent has spring contacts thereon that extend axially outwardly of the body of the receptacle in a manner that increases the height of the receptacle. Furthermore, the receptacle terminal of the Raynor patent has two parts, one of which is a molded plastic body part around which an electrical contact strip is fastened. Such design requires additional manufacturing and assembly steps.

An example of a single piece metal receptacle terminal is set forth in U.S. Pat. No. 4,797,110 granted to Richard L. Ponziani, William E. Davies and Everett P. Trittachuh III, Jan. 10, 1989 assigned commonly to the assignee of the present application. The receptacle terminal in the Ponziani et al patent while suitable for its intended purpose is not configured to be located on the component side of a circuit board that is wave soldered to electrically connect the components on one side of the board to conductor strips located on the solder bath side of the circuit board. Furthermore, the height of the receptacle terminal is too great for use with certain components such as instrument gage housings supported on the component side of circuit boards used in instrument panels for motor vehicles and the like.

Other receptacle terminals have been used by the assignee of the present invention, including those with a lock tab head portion with spring contacts located generally vertically within the head portion and with solder tabs on the outside of the head portion. In such cases, a lock tab is crimped to form the head portion. The solder tabs are crimped to connect the head portion to a circuit board so that the receptacle terminal can be electrically connected by wave soldering to conductor strips on the non-component side of the circuit board. Furthermore, such vertically disposed spring contacts have a sharp radius and a limited lateral clearance such that exposed electrical winding components can be electrically shorted against the receptacle when conductor pins thereon are inserted therein.

It is desirable that such receptacle terminals be simple in form and assembled without plural assembly steps such as required in two piece and lock tab constructions of the prior art. Furthermore, such receptacle terminals should be configured to enable them to be assembled in connector openings within a circuit board by use of automatic assembling equipment and by use of known solder bath techniques. Still further, it is desirable to provide an easily assembled, low cost receptacle terminal that will not short out electrical components connected thereto.

SUMMARY OF THE INVENTION

The invention is a low profile receptacle terminal for a printed circuit board having a component side and a conductor strip side. The receptacle terminal receives pins on electrical devices such as gage cans and coils found on the circuit board component of an instrument panel for a motor vehicle; the low profile receptacle of the present invention includes spring contact fingers with large radius fixed ends defining a clearance space to prevent such devices from electrically shorting out on the receptacle terminal.

The receptacle terminal has a head portion supported on the component side of a circuit board with a height that is less than present day receptacle terminals used for the same purpose. The head portion of the receptacle terminal is formed with a continuous perimeter wall that does not require a lock tab and plural spring contact fingers are formed integrally of and generally horizontally of the perimeter wall.

One feature of the present invention is to configure the spring contact fingers as cantilevers with large radius fixed ends so that they will define a clearance space for electrical devices connected thereto.

Another feature of the present invention is to configure the spring contact fingers as cantilevers with an end to end width such that the spring contact fingers will return to a free state pin gripping position.

An object of the present invention is to provide such a low profile receptacle terminal wherein spring clips integral to the head portion are included for axial insertion and fastening of the receptacle terminal onto a circuit board from the component side thereof by use of automated feed devices and wherein the spring clips are configured to hold the receptacle in place and to provide a surface area for flowing solder into electrical contact with conductor strips on the non-component side of the circuit board without flowing solder into the head portion so as to prevent return of the spring contact fingers to a free state position.

A further object of the present invention is to provide such a receptacle terminal wherein the spring contact fingers are each formed with a large radius fixed end and with a width that readily assumes a free state position following connection and release of a pin terminal with respect to the receptacle.

A still further object of the present invention is to provide a low profile receptacle terminal as a single unitary member having a head portion and two spaced clip members integral with the head portion and insertable through a connector opening in a circuit board for securing the receptacle terminal in place on the circuit board for connection to a circuit board having conductor strips on the non-component side thereof which are soldered to the terminal and having a component side on the other side thereof for receiving electrical components to be connected to the receptacle terminal and thence to the conductor strips and wherein the receptacle terminal comprises a head portion having a continuous perimeter wall thereon with an inner edge engageable with the circuit board on the component side thereof and a plurality of integral spring contact fingers each located substantially horizontally within the head portion to reduce the height thereof and each including a large radius fixed end and a free end spaced from the inner edge to provide a clearance space within the perimeter wall to prevent electrical shorting out windings of an electrical device against the receptacle terminal.

A further object is to provide such a low profile receptacle terminal locating such contact fingers above the component side of the circuit board a distance selected to prevent flow of solder to the integral spring contact fingers whereby the spring contact fingers retain their spring characteristics following soldering of the receptacle terminal on the circuit board; the receptacle terminal having two spaced clip members each having a free end adapted to be located inboard of the circuit board for solder connection to the conductor strips thereon and each having a fixed end formed integrally with the head portion at the inner edge and having a bend between the free end and the fixed end to hold the inner edge of the head portion in engagement with the circuit board during soldering of the receptacle terminal to the conductor strips on the non-component side of the circuit board and the two spaced clip members having an exposed surface thereon and a length for flow of solder across substantially all of said exposed surface area thereof and the perimeter surface having a height that will locate the free ends of the integral spring contact fingers away from the solder flow.

Yet another object of the present invention is to provide a receptacle terminal of the preceding object wherein each of the integral spring contact fingers has one end integrally connected to the perimeter wall by a large radius fixed end and each such finger further having a free end located inwardly thereof; the free ends forming an opening therebetween having a dimension when said spring contact fingers are in their free state which is less than that of the O.D. of a conductor pin to be connected therein and the free ends springing apart to accommodate the outer dimension of the conductor pin for spring bias electrical connection between the conductor pin and the head portion and wherein each of the spring contact fingers is dimensional between the free end thereof and the one end thereof to prevent the spring contact fingers from yielding during contact with a conductor pin so as to allow the spring contact fingers to return to their original free state following use.

Other advantages of the present invention will be readily appreciated as the same becomes better understood by reference to the following detailed description when considered in connection with the accompanying drawings wherein:

DESCRIPTION OF THE PREFERRED EMBODIMENT

Figure 1:
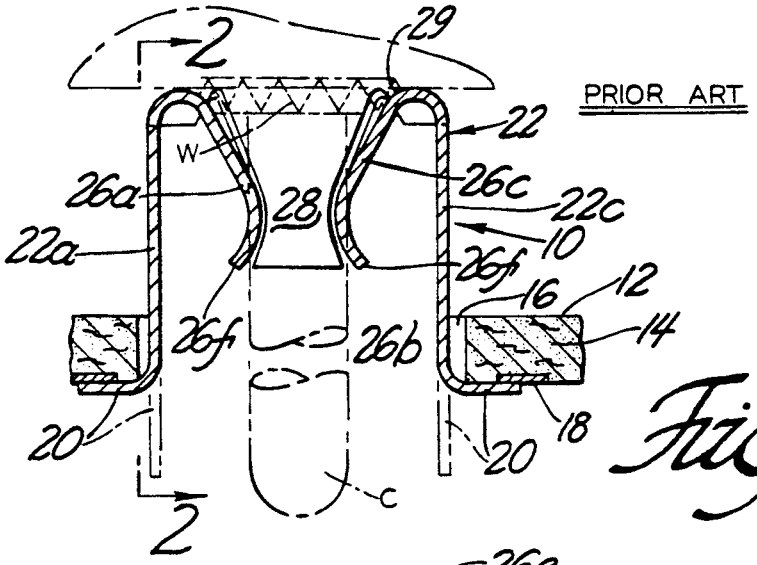
FIG. 1 is a sectional view of a prior art receptacle terminal having a high profile head portion with crimped tabs and sharp radius spring contact fingers shown in association with a gage conductor pin shown in broken outline.
Figure 2:
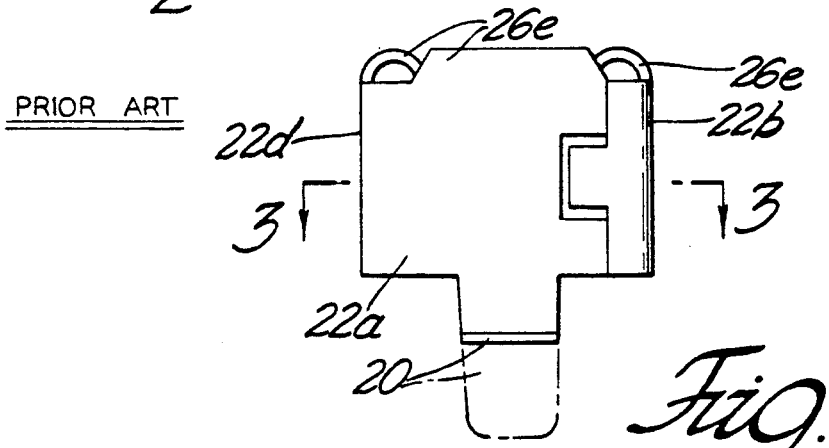
FIG. 2 is a side elevational view of the receptacle terminal of FIG. 1.
Figure 3:
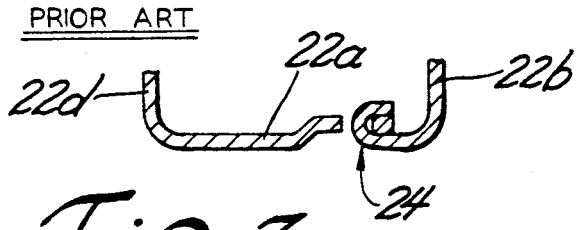
FIG. 3 is a fragmentary sectional view taken along the line 3—3 of FIG. 2, looking in the direction of the arrows.
Figure 4:
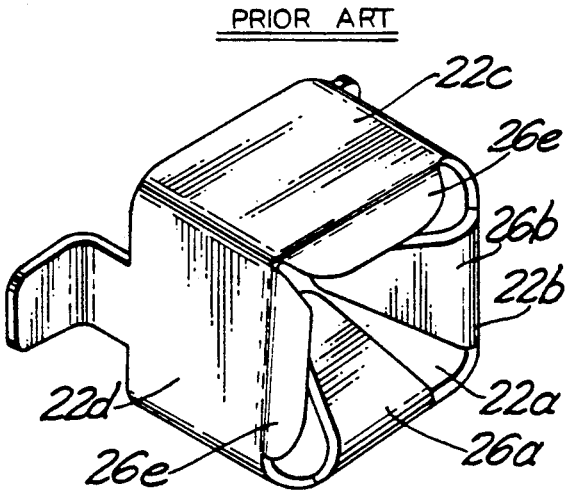
FIG. 4 is an isometric view of the receptacle terminal of FIG. 2.
Figure 8:
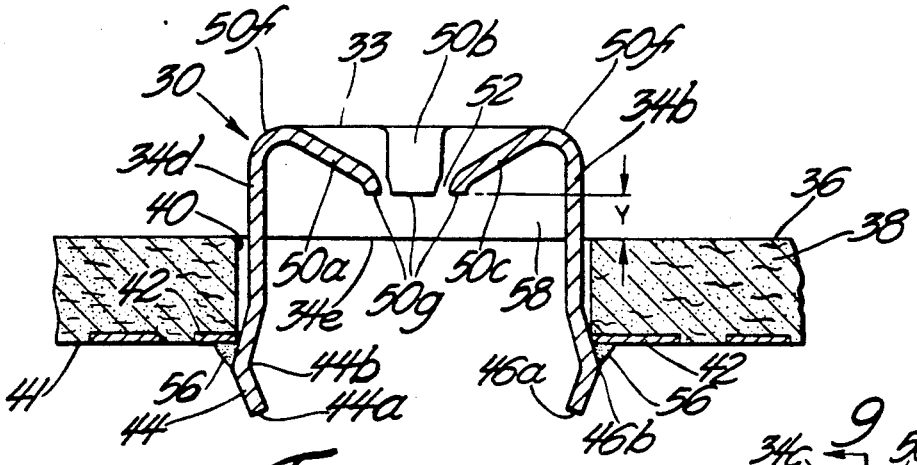
FIG. 8 is an enlarged sectional view taken along line 8—8 of FIG. 7 looking in the direction of the arrows.

Referring to FIGS. 1-5, a prior art receptacle terminal 10 is shown for connection on the component side 12 of a circuit board 14 through a receptacle opening 16 therein. The circuit board 14 includes electrical conductors 18 on the non-component side thereof that are wave soldered to crimped tab 20 on the receptacle terminal 10. The receptacle terminal 10 has a high profile head portion 22 formed with four sides **22*a*, 22*b*, 22*c*, and 22*d*. The sides 22*a* and 22*b* are interconnected by a lock tab 24. Furthermore, the receptacle terminal 10 includes four spring contact fingers 26*a*, 26*b*, 26*c* and 26*d* each having a sharp radius fixed end 26*e* formed integrally of one of the sides 22*a*, 22*b*, 22*c* and 22*d* respectively and each having a free end 26*f* that is slightly flared outwardly to form an opening 28** into which a pin conductor can be inserted when an electrical component such as a gage can or a coil in the instruments found on the instrument panel of a motor vehicle is electrically connected to the instrument panel.

It will be noted that the sharp radius end **26*e* on each contact arm 26*a*-26*d* limits the clearance space 29 between receptacle terminal 10** and windings W on the pin conductor C such that electrical shorting can occur therebetween.

Furthermore, the crimped tabs 20 thereon require a two step assembly in which the receptacle terminal 10 is first inserted through the opening 16 and thereafter the tabs 20 are crimped over from the backside of the circuit board to be located in contact with the electrical conductors 18.

Figure 6:
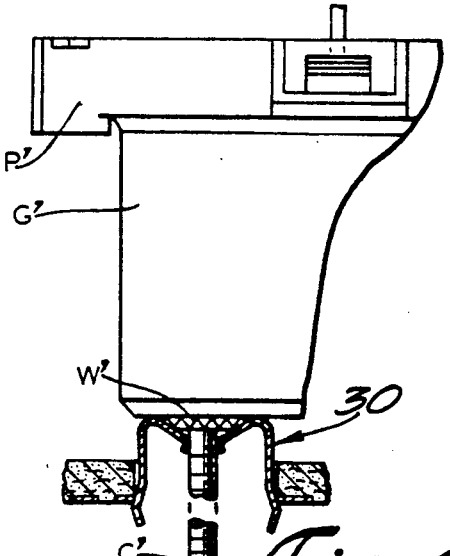
FIG. 6 is a sectional view of the receptacle terminal of the present invention shown in association with a circuit board and a mounted on an instrument panel of a motor vehicle.

Referring now to the present invention shown in FIGS. 6-9, a low profile receptacle terminal 30 is illustrated having a head portion 32 with an outer edge 33 and four integral walls **34*a*, 34*b*, 34*c*, and 34*d* each having an inner edge 34*e* that is engaged with the component side 36 of a circuit board 38 at a receptacle hole 40 therein leading to a non-component side 41 of the circuit board 38. Electrical conductor strips 42 on the non-component side 41 are soldered to two spaced integral clips 44, 46 integrally connected to and depending from the walls 34*d*, 34*b* respectively. As shown in FIG. 6, the space between the circuit board 38 and an instrument panel P is reduced because of the low profile receptacle terminal 30**.

Figure 7:
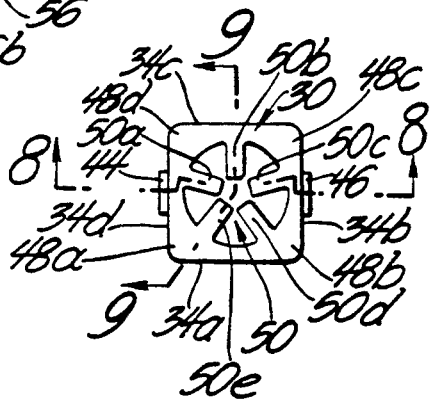
FIG. 7 is a top elevation view of the receptacle terminal of FIG. 6 with a gage removed.
Figure 9:
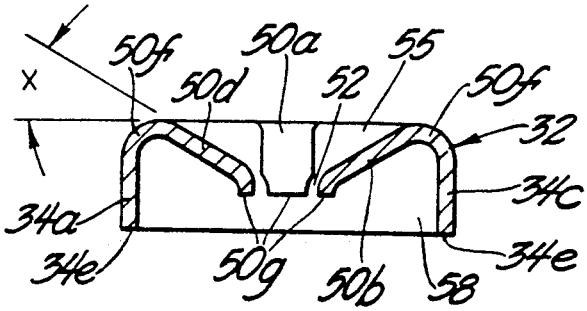
Fig.9 PRIOR ART
FIG. 9 is an enlarged sectional view taken along the line 9—9 of FIG. 7.
Figure 5:
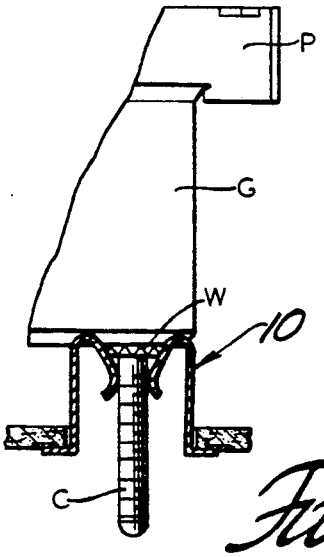
FIG. 5 is a sectional view of the receptacle terminal of the prior art invention in a circuit board for an instrument panel shown in association with a gage can having windings and conductor pins.

As shown in FIG. 7, each of the walls **34*a*-34*d* are connected to arcuately shaped corner fillets 48*a*, 48*b*, 48*c*, and 48*d* for reinforcing the corners of the head portion 32 and to define support for a penstar configuration 50 of spring contact fingers 50*a*-50*e*. Each of the spring contact fingers 50*a*, 50*b*, 50*c*, 50*d*, and 50*e* have a large radius fixed end 50*f* integrally connected to the head portion 32 at equidistantly spaced points on the inner edge surface 48*e* formed by the fillets 48*a*, 48*b*, 48*c* and 48*d*. Each of the spring contact fingers 50*a*, 50*b***, 50*c*, 50*d*, and 50*e* further have a free end 50*g* that is slightly bent in the direction of a line parallel to the longitudinal axis of the head portion 42 so as to form an opening 52 for receiving a conductor pin C' (FIG. 6) of slightly greater diameter than the opening 52. In accordance with one aspect of the invention, the spring contact fingers are located at an acute angle with respect to a horizontal plane defined by the outer edge 33 of the head portion 42 as shown at angle X in FIG. 9 whereby the height of the walls 34*a*–34*d* is substantially reduced thereby to produce a "low profile". The reduced height of the head portion 32 and the acute angle (30 degrees in one working embodiment) combine so that a wide clearance space 55, is provided between windings W' on conductor pin C' and the receptacle terminal 30 to prevent electrical shorting therebetween.

Spring clips 44, 46 each have a free end 44*a*, 46*a* that is inserted through the receptacle hole 40 in the circuit board in a single axial insertion step which is easily automated. Once snapped in place, the clips 44, 46 have an outwardly located bend 44*b*, 46*b* thereon located outwardly of the hole to lock the receptacle terminal 30 in place on the circuit board during the solder step. During soldering, clips 44, 46 are immersed within a solder bath. The configuration of the tabs enable them to be covered on at least 95% of their exposed surface with solder coating, e.g., a 60–40 tin-brass alloy is suitable. The solder coating forms a solder connection 56 between the clips 44, 46 and the conductor strips 42. The length of the clips 44, 46 is such that the solder will not flow into the interior 58 of the head portion 42. Accordingly, the free ends 50*g* remain free of solder such that they are free to deflect into the interior 58 as the conductor pin 54 is inserted into the receptacle following the solder connection.

In accordance with another aspect of the present invention, each of the spring contact fingers 50*a*–50*e* are cantilevered and have a controlled width between the fixed end 50*f* and the free end 50*g* thereof such that the free end 50*g* thereof will return to a retention diameter, less than, that of the diameter (O.D.) of a conductor pin C' removed therefrom. In one working embodiment, the contact fingers 50*a*–50*e* have a constant width of 1 millimeter end to end and a length of approximately 2.5 millimeters; the head portion 42 has a wall height of 2.5 millimeters and the free end 50*g* of the contact fingers in their free state are located a distance Y above the component side 36 of the circuit board 38 equal to 0.92 millimeters. The clips 44, 46 extend 4 millimeters below the side 36. Such configuration provides for ease of initial assembly and it further allows for locked connection of the receptacle terminal 30 to the circuit board without requiring a separate tab crimping step. A low profile head portion has spring contact fingers 50 that provide a widened clearance space 55 to prevent electrical shorting and the interior of the receptacle is maintained essentially solder free while the clips 44, 46 are wetted and electrically connected to the conductor strips on the non-component side of the circuit board.

While my invention has been described in terms of a preferred embodiment, it will be appreciated it has other uses as for example in association with cut lead lines requiring connection to sensor boards used in automotive control systems that are connected to lead wires of a wiring harness. Other additional forms are readily apparent to those skilled in the art. Accordingly, the scope of my invention is to be considered limited only by the following claims.

What is claimed is:

1. A single unitary receptacle terminal having a head portion and clip members integral with said head portion insertable through a connector opening in a circuit board for securing the receptacle terminal in place on the circuit board for solder connection to a circuit board having a plurality of conductor strips on one side thereof that are soldered to the terminal and having a component side on the other side thereof for receiving electrical components to be connected through the receptacle terminal to the conductor strips, the receptacle terminal comprising:

said head portion having a low profile perimeter wall thereon with an outer edge adapted to engage an electrical component and an inner edge engageable with the circuit board on the component side thereof and a plurality of integral spring contact fingers each located within said perimeter wall and each including a free end arranged at an acute angle to a place defined by said outer edge surface for defining a pin opening therebetween and each including a large radius fixed end to define a widened clearance space for accommodating an electrical device to prevent electrically shorting out the electrical device when a conductor pin thereon is inserted in said pin opening.

2. In the receptacle terminal of claim 1, said free ends being spaced from said inner edge and said component side of the circuit board a distance to prevent flow of solder against said integral spring contact fingers whereby said spring contact fingers retain their spring recovery characteristics following soldering of said receptacle terminal on the circuit board;

said single unitary receptacle terminal having two spaced integral clips each having a free end adapted to be located in spaced relationship to the conductor strip side of the circuit board for solder connection to the conductor strips thereon, each of said clips having a fixed end formed integrally with said head portion at said inner edge and a bend between said free end and said fixed end to hold said inner edge of said head portion in engagement with the circuit board during soldering of said receptacle terminal to the conductor strips on the one side of the circuit board and each of said clips having an exposed surface area thereon located on the conductor strip side of the circuit board and a length locatable in a solder bath for flow of solder across substantially all of said exposed surface area thereon and said perimeter wall having a height that will locate the free ends of said integral spring contact fingers away from the solder flow across said exposed surface area.

3. A single unitary receptacle terminal having a head portion and clips integral with said head portion insertable through a connector opening in a circuit board for securing the receptacle terminal in place on the circuit board for solder connection to a circuit board having a plurality of conductor strips on one side thereof which are soldered to the terminal and having a component side for receiving electrical components to be connected through the receptacle terminal to the conductor strips, the receptacle terminal comprising:

a low profile head portion having a perimeter wall thereon with an outer edge and an inner edge engageable with the circuit board at the component side thereof and a plurality of integral spring contact fingers each located interiorly of said perimeter wall and below the upper edge thereof at an acute angle to reduce the height of said head portion and each of said integral spring contact fingers including a free end spaced from said component side a distance selected to prevent flow of solder to said integral spring contact fingers whereby said spring contact fingers retain their spring recovery characteristics following soldering of said receptacle terminal on the circuit board;

two spaced clips integrally formed on said low profile head portion each having a free end adapted to be located in spaced relationship to the conductor strip side of the circuit board for solder connection to the conductor strips thereon and each having a fixed end formed integrally with said head portion at said inner edge and each having a bend between said free end and said fixed end to hold said inner edge of said head portion in engagement with the circuit board during soldering of said receptacle terminal to the conductor strips on the one side of the circuit board and said two spaced clips having an exposed surface area thereon located on the conductor strip side of the circuit board;

said two spaced clips locatable in a solder bath for flow of solder across substantially all of said exposed surface area thereof and said perimeter wall having a height that will locate the free ends of said integral spring contact fingers to be free of the solder flow across said exposed surface area.

4. A single unitary receptacle terminal having a head portion and two spaced clips integral with said head portion and insertable through a connector opening in a circuit board for securing the receptacle terminal in place on the circuit board for connection to a circuit board having a plurality of conductor strips on one side thereof which are soldered to the terminal and having a component side for receiving electrical components to be connected through the receptacle terminal to the conductor strips the receptacle terminal comprising:

a low profile head portion having a perimeter wall thereon with an inner edge engageable with said circuit board on the component side thereof and an upper edge; a plurality of integral spring contact fingers each located interiorly of said perimeter wall and at an acute angle below the upper edge thereof to reduce the height of said receptacle terminal to that of said perimeter surface and each of said integral spring contact fingers including a free end spaced from said upper edge to provide a widened clearance space between a component connected thereto and said perimeter wall so as to prevent electrical shorting therebetween.

5. The single unitary receptacle terminal of claim 4, further comprising:

said perimeter wall having a height greater than the free state height of said integral spring contact fingers when said head portion is assembled on the circuit board for locating said integral spring contact fingers above a solder bath for preventing wicking of solder thereagainst as the conductor strips on the circuit board are soldered to said clip members;

each of said integral spring contact fingers cantilevered from said perimeter wall and having one end integrally connected to said perimeter wall and having a free end located inwardly thereof; said free ends forming a pin opening therebetween having a dimension when said spring contact fingers are in their free state which is less than that of a conductor pin to be connected therein and expandable to the dimension of the conductor pin for spring biased electrical connection between the conductor pin and said head portion and said fingers being deflectable back to said free state following use to maintain said pin opening dimension smaller than the dimension of the conductor pin.

6. The single unitary receptacle terminal of claim 4, further comprising said clips each having a free end adapted to be located inboard of the circuit board for solder connection to the conductor strips thereon and each having a fixed end formed integrally with said head portion at said inner edge and having a bend between said free end and said fixed end to hold said inner edge of said head portion in engagement with the circuit board during soldering of said receptacle terminal to the conductor strips on the one side of the circuit board and said clips having an exposed surface area thereon located on the conductor strip side of the circuit board;

said clips having a length for locating them in a solder bath for flow of solder across substantially all of said exposed surface area thereof to wet the conductor strips to form a solder joint between said clips and said conductor strips and said perimeter wall having a height that will isolate the free ends of said integral spring contact fingers from solder wicking.

* * * * *